US010143614B1

(12) United States Patent
Pelletier

(10) Patent No.: US 10,143,614 B1
(45) Date of Patent: Dec. 4, 2018

(54) CUP HOLDER FOR A CRUTCH

(71) Applicant: Samuel J. Pelletier, Fairfield (CA)

(72) Inventor: Samuel J. Pelletier, Fairfield (CA)

( * ) Notice: Subject to any disclaimer, the term of this patent is extended or adjusted under 35 U.S.C. 154(b) by 0 days.

(21) Appl. No.: 15/718,013

(22) Filed: Sep. 28, 2017

Related U.S. Application Data

(60) Provisional application No. 62/526,399, filed on Jun. 29, 2017.

(51) Int. Cl.
*A61H 3/02* (2006.01)
*A61H 3/00* (2006.01)

(52) U.S. Cl.
CPC ..... *A61H 3/02* (2013.01); *A61H 2003/002* (2013.01)

(58) Field of Classification Search
CPC .. A61H 3/02; A61H 2003/002; A61H 3/0244; A45B 3/00; A45B 2009/002; A45C 13/28
USPC ..... 135/65, 66, 68, 84; 224/407, 248, 414; 248/309.1, 311.2, 317, 340; 220/703, 220/737; 119/102
See application file for complete search history.

(56) References Cited

U.S. PATENT DOCUMENTS 1,530,256 A * 3/1925 Garland ..... A47G 23/0216 220/738
3,429,541 A * 2/1969 Herman ..... A61H 3/02 135/68
3,734,439 A * 5/1973 Wintz ..... A47G 23/0241 131/241
4,289,156 A * 9/1981 Ulics ..... A61H 3/00 135/66
5,101,845 A * 4/1992 Kravetz ..... A45B 3/00 135/66
5,190,257 A * 3/1993 Gradei ..... B62J 11/00 248/231.71
5,647,519 A * 7/1997 Brennan ..... A61H 3/02 135/66
5,803,327 A * 9/1998 Nipper ..... A61H 3/02 135/66
5,806,817 A * 9/1998 Loud ..... E06C 7/14 248/210
D411,654 S * 6/1999 Olkey ..... D3/10
6,783,103 B2 * 8/2004 Salani ..... E06C 7/143 248/210
7,513,268 B2 * 4/2009 Doman ..... A61H 3/02 135/66
8,033,518 B2 10/2011 Schuchman
8,146,614 B2 * 4/2012 Ford ..... A45B 3/00 135/66
2006/0091276 A1 5/2006 Ward

* cited by examiner

*Primary Examiner* — Winnie Yip
(74) *Attorney, Agent, or Firm* — Cramer Patent & Design, PLLC; Aaron R. Cramer

(57) ABSTRACT

A liquid holding having a generally "U" shaped vertical frame with a first vertical arm having an outwardly extending first retaining fastener and a second vertical arm with an outwardly extending second retaining fastener. An upper ring is affixed to an upper portion of the first vertical arm and to an upper portion of the second vertical arm. The vertical frame is configured such that the first retaining fastener and the second retainer fastener fit into grip adjustment holes of a crutch. The vertical frame is further configured to retain a liquid container between the first vertical arm and the second vertical arm.

14 Claims, 3 Drawing Sheets

CUP HOLDER FOR A CRUTCH

RELATED APPLICATIONS

The present invention was first described in and claims the benefit of U.S. Provisional Patent Application No. 62/526,399 filed on Jun. 29, 2017, the entire disclosures of which are incorporated herein by reference.

FIELD OF THE INVENTION

The presently disclosed subject matter is directed to cup holders. More particularly, it is directed to cup holders for crutches.

BACKGROUND OF THE INVENTION

People with physical disabilities such as the elderly, the handicapped, as well as those recovering from injuries or surgery often encounter difficulties while performing tasks that most take for granted. What comes easily to those without disabilities, such as climbing stairs or dressing themselves, can become very difficult or even impossible to do without assistance. For example, those who require crutches lack the free use of their hands while moving about which can make doing trivial things, such as carrying items, very difficult.

While some crutch users resort to backpacks or purses to carry items as they move about others simply place items in their pockets. While such measures are effective in many instances there are times such as when trying to carry liquids that those measures fail. Items such as cups and other liquid containers often cannot easily be transported no matter how much care is taken because due to their content's temperature or medicinal value spilling must be totally avoided.

Accordingly, there exists a need for a device by which cups, bottles and similar liquid containers can be easily transported by those using crutches. Such a container holding device should be simple to use without special training and should provide a means of avoiding spilling. Preferably such a container should be suitable for being made available at relatively low cost. Ideally such a device would be suited for being part of a new pair crutches or as an add-on feature.

SUMMARY OF THE INVENTION

The principles of the present invention provide for devices by which cups, bottles and similar liquid containers can be easily transported by those using crutches. Such devices are simple and easy to use without special training, provide a means of avoiding spilling, are suitable for being made available at relatively low cost, and can be used a part of an original pair of crutches or an add-on feature.

A liquid holding device in accord with the present invention includes a vertical frame having a first vertical arm with an outwardly extending first retaining fastener and a second vertical arm with an outwardly extending second retaining fastener. There is an upper ring affixed to an upper portion of the first vertical arm and to an upper portion of the second vertical arm. The vertical frame is configured such that the first retaining fastener and the second retainer fastener fit into holes of a crutch. The vertical frame is further configured to retain a liquid container between the first vertical arm and the second vertical arm.

In practice, the first retaining fastener comprises a first fastener head located inside the first vertical arm and a first fastener shaft that extends outward from the first vertical arm. Preferably the first fastener shaft passes through the first vertical arm and snap-fits into the first vertical arm. The upper ring and the first vertical arm should be sufficiently flexible so as to enable the first vertical arm to be compressed toward the second vertical arm so as to enable the first fastener shaft to fit into a crutch hole. Beneficially, the upper ring biases the first vertical arm back to its resting position when compression force is removed. Also may be included is a lower ring that is affixed to the first vertical arm and to the second vertical arm but below the upper ring. The lower ring and the upper ring may be comprised of the same material. Also beneficially the vertical frame is generally "U"-shaped.

A crutch that is in accord with the present invention includes a crutch frame structure having an adjustable hand grip, an arm pad, a bottom, and grip adjustment holes. The crutch further includes a liquid holding device that is attached to the crutch frame structure. The vertical frame has a first vertical arm with an outwardly extending first retaining fastener and a second vertical arm with an outwardly extending second retaining fastener. The liquid holding device further includes an upper ring that is affixed to an upper portion of the first vertical arm and to an upper portion of the second vertical arm. The first retaining fastener and the second retainer fastener fit into the grip adjustment holes, and the vertical frame is further configured to retain a liquid container between the first vertical arm and the second vertical arm.

The first retaining fastener comprises a first fastener head that is located inside the first vertical arm and a first fastener shaft that extends outward from the first vertical arm. In practice, the first fastener shaft passes through the first vertical arm and snap-fits into the first vertical arm.

The upper ring and the first vertical arm should be sufficiently flexible as to enable the first vertical arm to be compressed toward the second vertical arm so as to enable the first fastener shaft to fit into a crutch grip adjustment hole. The upper ring may also bias the first vertical arm back to its resting position when the compression force is removed, preferably to bias the first fastener shaft into its grip adjustment hole. Also included may be a lower ring that is affixed to the first vertical arm and to the second vertical arm but below the upper ring. The lower ring and the upper ring are preferably comprised of the same material. The vertical frame is ideally generally "U"-shaped. There may be a rubber cap on the bottom.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
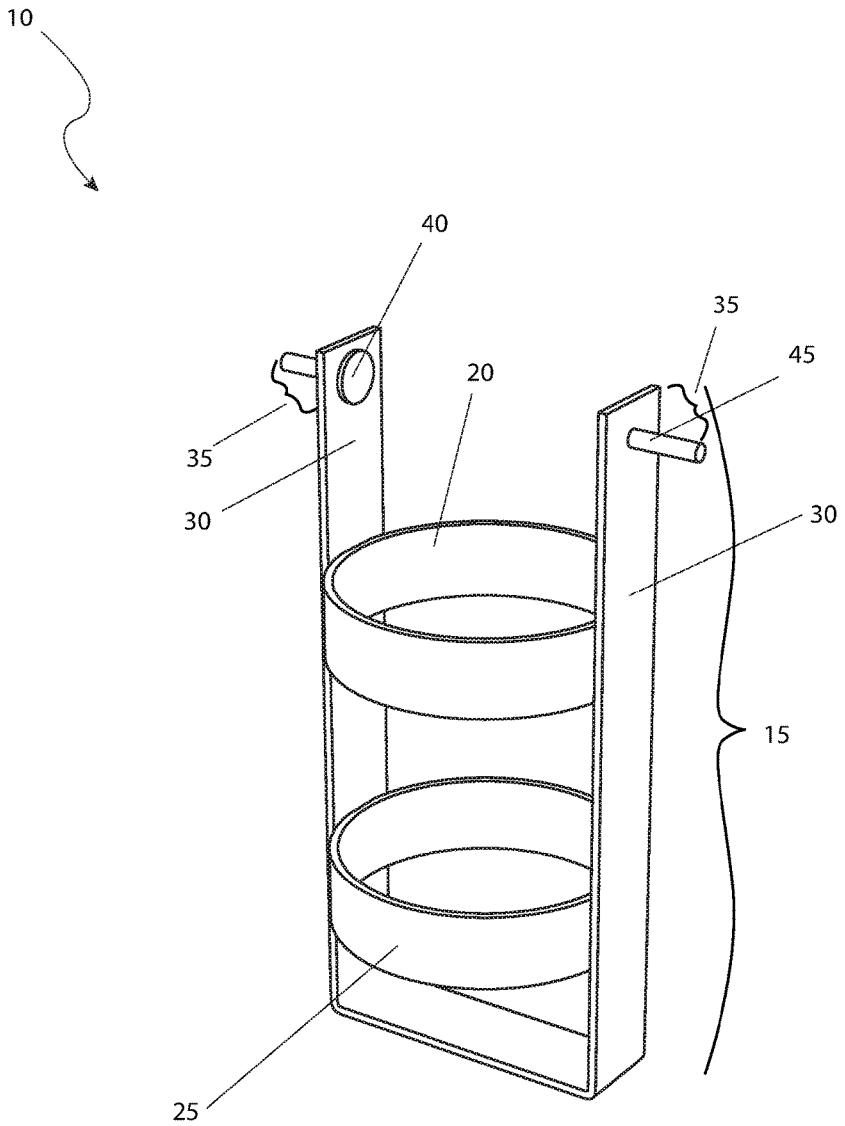
FIG. 1 is an isometric view of a liquid holding device 10 that is in accord preferred embodiment of the present invention.

10 liquid holding device
15 vertical frame
20 upper ring

25 lower ring
30 vertical arm
35 retaining fastener
40 fastener head
45 fastener shaft
50 crutch
55 rubber cap
60 hand grip
65 arm pad
70 hand grip adjustment hole
75 frame structure
80 travel path
85 beverage container
90 user
95 hands

DETAILED DESCRIPTION OF THE PREFERRED EMBODIMENT

Figure 2:
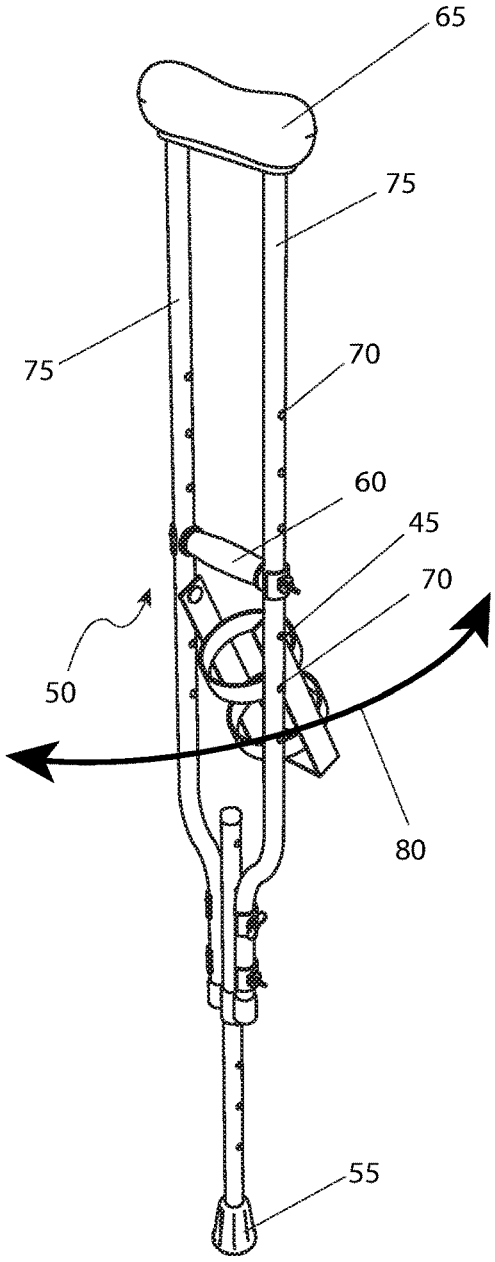
FIG. 2 presents an isometric view of the liquid holding device 10 shown in FIG. 1 installed upon a crutch 50; and, FIG. 3 is a perspective view of the liquid holding device 10 shown in FIG. 1 and in FIG. 2 when in use.
Figure 3:
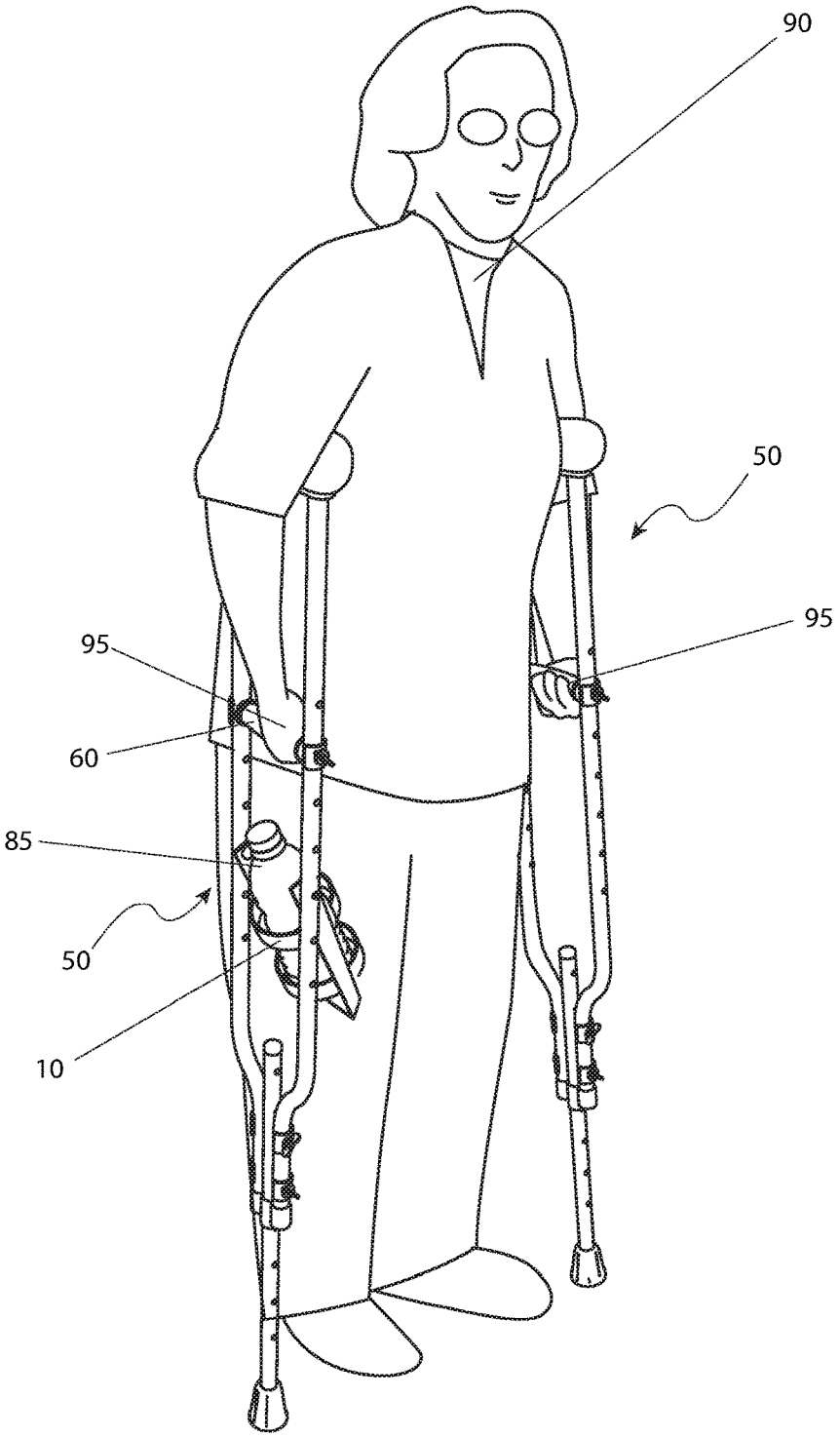

The preferred embodiment of the present invention is depicted in FIG. 1 through FIG. 3. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items.

Refer now to FIG. 1 for an isometric view of the liquid holding device 10. The liquid holding device 10 is designed to temporarily secure a liquid in a container (shown as a beverage container 85 in FIG. 3) to one (1) crutch 50 of a pair of crutches 50. The liquid container allows a user 90 (see FIG. 3) to transport the liquid while still being afforded the full use of the crutches 50.

The liquid holding device 10 includes a generally "U"-shaped vertical frame 15 which is partially defined by vertical arms 30. It is envisioned that the vertical frame 15 is approximately eight to ten inches (8-10 in.) tall and about four inches (4 in.) wide. The liquid holding device 10 also includes an upper ring 20 and a lower ring 25 that are attached to the vertical arms 30 so as to divide the vertical frame 15 into three (3) sections. The vertical arms 30, upper ring 20, and lower ring 25 are envisioned as being approximately three-quarters of an inch (¾ in.) wide. In practice, the vertical arms 30, upper ring 20, and lower ring 25 can be made from steel, another metal such as aluminum, an impact resistant plastic, fiberglass, or another durable material.

The vertical arms 30, the upper ring 20 and the lower ring 25 are sufficiently flexible as to enable the vertical arms 30 to be compressed toward one (1) another while biasing the vertical arms 30 back to their resting separation when the compression force is removed.

At the top of each vertical arm 30 is a retaining fastener 35. Each retaining fastener 35 has a flat fastener head 40 (only one (1) being shown in FIG. 1 due to illustrative limitations) and a fastener shaft 45 (again, only one (1) shown due to illustrative limitations). The fastener heads 40 are of a low-profile design and are located on the inside of each vertical arm 30. The fastener shafts 45 extend outward from their respective fastener head 40 and pass through their respective vertical arms 30. The fastener shafts 45 are beneficially straight "snap" connectors that snap-fit into holes (not shown) in their respective vertical arms 30. However, other types of fasteners such threaded shafts, friction clips, cotter pins and the like could also be used. As described subsequently the fastener shafts 45 are used to attach their respective vertical arm 30, and thus the liquid holding device 10, to a crutch 50.

Referring now to FIG. 2 where the liquid holding device 10 is shown attached to a crutch 50. The crutch 50 is of a conventional design and includes a bottom rubber cap 55, an adjustable hand grip 60, and an arm pad 65. The fastener shafts 45 fit through unused hand grip adjustment holes 70 of the frame structure 75 of the crutch 50. The flexibility of the vertical arms 30, upper ring 20 and lower ring 25 enable a user 90 to compress vertical arms 30 toward one (1) to fit the fastener shafts 45 into the unused hand grip adjustment holes 70. In addition, those components bias the vertical arms 30 back to their resting separation when the compression is removed so as to retain the liquid holding device 10 on the crutch 50.

Supplemental attachment devices such as nuts, cotter pins, clamps or the like may be used on the fastener shaft 45 if desired, although such will not usually be necessary. The liquid holding device 10 is suitable for use on both aluminum or laminated wood crutches due to the universal attachment fastener shafts 45. The fastening arrangement provided by the retaining fasteners 35 allow the liquid holding device 10 to relatively freely swing along a travel path 80. That arrangement allows the liquid holding device 10 to remain relatively level as the crutch 50 is angled to the side for walking and support. In practice, the liquid holding device 10 can be easily used to transport a beverage container 85 (see FIG. 3) such as a bottle, cup, can, or the like, and may be used with either hot or cold beverages or with other liquids such as medications.

Refer finally to FIG. 3 for a perspective view of the liquid holding device 10 being used by a user 90 on a crutch 50 (herein depicted as being the right crutch 50). A beverage container 85 is positioned within the liquid holding device 10 where it remains via gravity and the actions of the faster shafts 45 through the hand grip adjustment holes 70 until the user 90 removes the beverage container 85. The deep-well nature of the liquid holding device 10 ensures that the beverage container 85 will not inadvertently fall out. This also enables the user 90 to easily retrieve, consume from, and then replace the beverage container 85. Thus, the user 90 can easily transport a beverage container 85 while their hands 95 grip the hand grips 60 or perform other tasks.

The preferred embodiment of the present invention can be utilized by the common user 90 in a simple and effortless manner and with little or no training. It is envisioned that the liquid holding device 10 would be constructed in general accordance with FIG. 1 and FIG. 2 and installed as shown in FIG. 3. The liquid holding device 10 could be procured as an integral part of a set of crutches 50 or it might be procured separately as an attachment to a crutch 50.

To attach the liquid holding device 10 to a crutch 50 the fastener shafts 45 would be inserted into a matching set of unused hand grip adjustment holes 70. Then, if used, an external fastener would be attached to a fastener shafts 45. The liquid holding device 10 is then ready for use.

A user 90 could then insert a beverage container 85 into the liquid holding device 10. The user 90 could then move about using the crutch 50 normally. As desired that user 90 could remove the beverage container 85, consume some of its contents, replace the beverage container 85 back into the liquid holding device 10, and continue walking.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A liquid holding device, comprising:

a vertical frame having a first vertical arm with an outwardly extending first retaining fastener and a second vertical arm with an outwardly extending second retaining fastener;

an upper ring affixed to an upper portion of said first vertical arm and to an upper portion of said second vertical arm;

wherein said vertical frame is configured such that said first retaining fastener and said second retainer fastener fit into holes of a crutch;

wherein said vertical frame is further configured to retain a liquid container between said first vertical arm and said second vertical arm;

wherein said first retaining fastener comprises a first fastener head located inside said first vertical arm and a first fastener shaft that extends outward from said first vertical arm;

wherein said first fastener shaft passes through said first vertical arm; and, wherein said first fastener shaft snap-fits into said first vertical arm.

2. The liquid holding device of claim 1, wherein said upper ring and said first vertical arm are sufficiently flexible as to enable said first vertical arm to be compressed toward said second vertical arm so as to enable said first fastener shaft to fit into a crutch hole.

3. The liquid holding device of claim 2, wherein said upper ring biases said first vertical arm back to its resting position when compression force is removed.

4. The liquid holding device of claim 3, further including a lower ring affixed to said first vertical arm and to said second vertical arm and below said upper ring.

5. The liquid holding device of claim 4, wherein said lower ring and said upper ring are comprised of the same material.

6. The liquid holding device of claim 1, wherein said vertical frame is generally "U"-shaped.

7. A crutch, comprising:

a crutch frame structure having an adjustable hand grip, an arm pad, a bottom, and grip adjustment holes; and, a liquid holding device attached to said crutch frame structure, said liquid holding device including a vertical frame having a first vertical arm with an outwardly extending first retaining fastener and a second vertical arm with an outwardly extending second retaining fastener, said liquid holding device further including an upper ring affixed to an upper portion of said first vertical arm and to an upper portion of said second vertical arm;

wherein said first retaining fastener and said second retainer fastener fit into said grip adjustment holes;

wherein said vertical frame is further configured to retain a liquid container between said first vertical arm and said second vertical arm;

wherein said first retaining fastener comprises a first fastener head located inside said first vertical arm and a first fastener shaft that extends outward from said first vertical arm;

wherein said first fastener shaft passes through said first vertical arm; and, wherein said first fastener shaft snap-fits into said first vertical arm.

8. The crutch according to claim 7, wherein said upper ring and said first vertical arm are sufficiently flexible as to enable said first vertical arm to be compressed toward said second vertical arm so as to enable said first fastener shaft to fit into a crutch hole.

9. The crutch according to claim 8, wherein said upper ring biases said first vertical arm back to its resting position when compression force is removed.

10. The crutch according to claim 9, wherein said upper ring biases said first fastener shaft into its grip adjustment hole.

11. The liquid holding device of claim 9, further including a lower ring affixed to said first vertical arm and to said second vertical arm and below said upper ring.

12. The liquid holding device of claim 11, wherein said lower ring and said upper ring are comprised of the same material.

13. The liquid holding device of claim 7, wherein said vertical frame is generally "U"-shaped.

14. The liquid holding device of claim 7, further including a rubber cap on said bottom.

* * * * *